United States Patent [19]

Blonder

[11] Patent Number: 4,468,674

[45] Date of Patent: Aug. 28, 1984

[54] ASSYMETRICAL FOLDED HALF-DIPOLE AND LINEAR EXTENSION ANTENNA ARRAY

[75] Inventor: Isaac S. Blonder, Morganville, N.J.

[73] Assignee: Blonder-Tongue Laboratories, Inc., Old Bridge, N.J.

[21] Appl. No.: 400,978

[22] Filed: Jul. 22, 1982

[51] Int. Cl.[3] ..... H01Q 21/08

[52] U.S. Cl. ..... 343/815; 343/816; 343/803

[58] Field of Search ..... 343/815, 819, 817, 818

[56] References Cited

U.S. PATENT DOCUMENTS 2,700,105 1/1955 Winegard ..... 343/819
2,701,308 2/1955 Kay ..... 343/794
3,543,277 11/1970 Pullara ..... 343/792.5
4,218,686 8/1980 Blonder ..... 343/819

*Primary Examiner*—Eli Lieberman
*Assistant Examiner*—Karl Ohralik
*Attorney, Agent, or Firm*—Rines and Rines, Shapiro and Shapiro

[57] ABSTRACT

This disclosure is concerned with a linear antenna array mounted on a conductive longitudinal boom, as in a Yagi-type array or the like, having a plurality of assymmetrical transversely extending folded half dipoles and linear extensions thereof disposed at successive longitudinally spaced locations along the boom, with the folded half dipoles of successive antennas extending from opposite sides of said boom.

6 Claims, 1 Drawing Figure

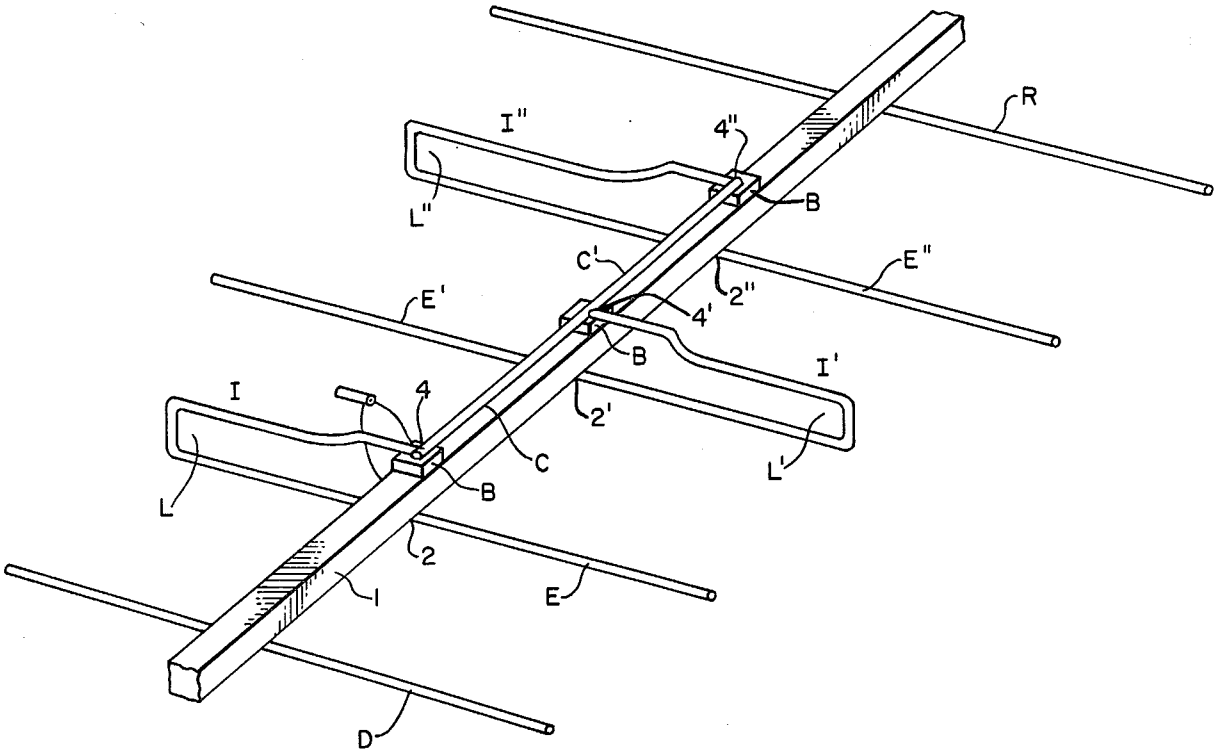
R
E"
B
4"
2"
I"
L"
C'
4'
B
2'
I'
L'
E'
C
B
4
2
I
L
E
D

ASSYMETRICAL FOLDED HALF-DIPOLE AND LINEAR EXTENSION ANTENNA ARRAY

The present invention relates to linear antenna arrays and the like, being more particularly directed to arrays as of the Yagi and related types employing folded type dipoles and linear elements.

In my earlier U.S. Pat. No. 4,218,686, issued Aug. 19, 1980, an advantageous antenna of this type is described in which assymetrical linear elements interact with folded dipoles to compensate for the unbalance of the folded dipole antenna feed and thereby to provide improved radiation pattern, impedance matching, and other performance characteristics over relatively wide frequency bands. This technique involved interaction with "hot" and ground sides of a full folded dipole fed by conventional coaxial feed techniques.

There are occasions where it is advantageous not to have both "hot" and ground folded dipole antenna loops and where conventional parallel or coaxial feed and matching techniques are not suitable. In accordance with the present invention, the assymmetrical phenomenon of said Letters Patent is combined in a novel manner with a plurality of successive folded half-dipoles ("hot" side loops only) and linear extensions thereof to achieve the highly novel result of enabling the use of a vastly simplified feed construction providing matching over multi-frequency bands of somewhat more limited extent.

An object of the invention, accordingly, is to provide such a novel multi-folded half-dipole array suitable for use with a single conductive boom and in configurations such as of the Yagi type, to attain the above-described and other advantages.

A further object is to provide a novel antenna array of more general applicability, as well.

Other and further objects are explained hereinafter and are more particularly pointed out in connection with the appended claims.

In summary, however, from one of its aspects, the invention embraces a linear antenna array comprising a conductive boom extending along a longitudinal line, and a plurality of transversely extending folded half-dipoles and assymmetrical-length extensions of an arm thereof, disposed at successive longitudinally spaced locations along the boom, with the end of the said folded half dipole from which the extension continues being connected to the boom, and the other end of the folded half-wave dipole being disposed laterally spaced from the boom, successive antenna folded half-dipoles extending from opposite sides of the boom, and conductive means extending substantially parallel to and laterally of the boom interconnecting the said other ends of successive folded half-wave dipoles. Preferred best mode embodiments are hereinafter set forth.

The invention will now be described in connection with the accompanying drawing, the single FIGURE of which is an isometric view of a preferred form of the invention.

Referring to the drawing, a single longitudinally extending conductive boom support is shown at 1 mounting at successive spaced longitudinal locations a plurality (shown as three) of "driven" antennas I, I' and I'', each comprising a half only ("hot" side) of a folded dipole loop L, L' and L'', each disposed extending transversely from a side of the boom, and with one of the free ends of each of which connected to the boom, as at 2, 2' and 2'', from which connection there extends transversely from the other side of the boom 1, linear antenna extensions E, E' and E'', respectively. In accordance with the invention, the other free ends 4, 4' and 4'' of the respective succesively mounted folded half dipole loops L, L' and L'', are bent laterally outward of the boom 1 and are interconnected by conductive straps C, C', serving as the other feed conductor for the dipole loops, supported upon insulator blocks B, and extending substantially parallel to the boom 1 but laterally spaced therefrom. The folded half-dipole loop antennas L, L', and L'' are preferably oriented with the plane of their loops substantially orthogonally intersecting the line of the boom 1.

The invention, as before stated, in its best mode, uses assymetrical lengths of loop L and linear extension E, from an arm thereof; of loop L' and extension E'; and of loop L'' and extension E'', with the lengths of antennas I, I' and I'' being successively longer (corresponding to successively lower frequencies in a predetermined band). Surprisingly, excellent impedance matching is achievable when successive loops L, L', L'' extend from opposite sides of the boom from the preceding antenna, and with the boom and substantially parallel strap connectors C—C' serving as the feed.

Considering the VHF television band from channel 7 to channel 13, as an example, loop L may be $12\frac{1}{2}''$ with the linear extension E from its inner arm being of non-symmetrical length, about 15% longer, namely about $14\frac{3}{8}''$; loop L', 13'', with extension E', $15\frac{1}{2}''$; loop L'', $13\frac{3}{4}''$ and extension E'', 16''. The longitudinal spacing between the successive antennas may be 15'' (about a twentieth of the wavelength). As shown, parasitic directors D or reflectors R may be connected to the boom beyond the driven elements for additional directivity and reduced back lobes.

While three driven elements are shown in the linear array, two elements may be used and more than three, if desired. Further modifications will also occur to those skilled in the art and are considered to fall within the spirit and scope of the invention as defined in the appended claims.

What is claimed is:

1. A linear antenna array comprising a conductive boom extending along a longitudinal line, a plurality of transversely extending antennas mounted at longitudinally spaced locations along the boom and each having a folded antenna loop disposed on one side of the boom with one free end of the loop connected to the boom and a conductive extension therefrom disposed on the opposite side of the boom, and with the other free end of the loop terminating at a point spaced laterally of the boom; conductive strap means extending laterally substantially parallel to the boom and connecting the said other free ends of successive antenna loops; and the loops of successive antennas being disposed on opposite sides of the boom.

2. An antenna array as claimed in claim 1 and in which the said loop antennas are oriented with the plane of the loop disposed transversely orthogonal to said line.

3. An antenna array as claimed in claim 1 and in which the lengths of the loop of each antenna and the extension thereof are assymmetrical.

4. An antenna array as claimed in claim 3 and in which the loop and extension lengths of the antennas are successively longer.

5. An antenna array as claimed in claim 4 and in which at least one of parasitic director and reflector means are disposed at points of the boom beyond said plurality of antennas.

6. A linear antenna array comprising a conductive boom extending along a longitudinal line, and a plurality of transversely extending folded half-dipoles and assymmetricallength extensions of an arm thereof, disposed at successive longitudinally spaced locations along the boom, with the end of the said folded half-dipole from which the extension continues being connected to the boom, and the other end of the folded half-wave dipole being disposed laterally spaced from the boom, successive antenna folded half-dipoles extending from opposite sides of the boom, and conductive means extending substantially parallel to and laterally of the boom interconnecting the said other ends of successive folded half-wave dipoles.

* * * * *